United States Patent [19]

Landingham

[11] Patent Number: 4,560,621

[45] Date of Patent: Dec. 24, 1985

[54] POROUS METALLIC BODIES

[75] Inventor: Richard L. Landingham, Livermore, Calif.

[73] Assignee: The United States of America as represented by the United States Department of Energy, Washington, D.C.

[21] Appl. No.: 589,255

[22] Filed: Mar. 13, 1984

[51] Int. Cl.[4] ..... B22F 3/10; B22F 3/16

[52] U.S. Cl. ..... 428/566; 75/245; 75/250; 419/2; 419/23; 419/31; 419/38

[58] Field of Search ..... 419/2, 31, 23, 38; 75/20 F, 245, 250; 428/566

[56] References Cited

U.S. PATENT DOCUMENTS

| | | | |
|---|---|---|---|
| 3,669,654 | 6/1972 | Berry, Jr. | 75/20 F |
| 3,816,952 | 6/1974 | Niebyski et al. | 75/20 F |
| 3,843,353 | 10/1974 | Niebylski et al. | 75/20 F |
| 3,961,909 | 6/1976 | Shapiro | 29/192 CP |
| 4,183,744 | 1/1980 | Fischer et al. | 75/20 F |
| 4,261,937 | 4/1981 | Rinde | 264/28 |
| 4,325,737 | 4/1982 | Rinde | 106/122 |
| 4,360,569 | 11/1982 | Steyert et al. | 419/2 |
| 4,432,935 | 2/1984 | Kubo et al. | 419/2 |

*Primary Examiner*—Allan M. Lieberman

*Attorney, Agent, or Firm*—Shyamala T. Rajender; L. E. Carnahan; Judson R. Hightower

[57] ABSTRACT

Porous metallic bodies having a substantially uniform pore size of less than about 200 microns and a density of less than about 25 percent theoretical, as well as the method for making them, are disclosed. Group IIA, IIIB, IVB, VB, and rare earth metal hydrides are heated in a confining container at a controlled rate to a temperature of about greater than the temperature at which the hydride decomposes. Hydrogen is removed from the container and the remaining metal is heated during a second stage to a temperature greater than the temperature at which it was previously heated but not greater than the temperature of $\frac{1}{2}$ to $\frac{2}{3}$ the temperature at which the metal melts at a controlled rate. The resulting porous metallic body produced has a density less than about 25 percent theoretical and a pore size of less than about 200 microns. The metallic particles of the present invention have high inner surface area and possess minimum resistance to gas flow.

14 Claims, No Drawings

POROUS METALLIC BODIES

The United States Government has rights in this invention pursuant to Contract No. W-7405-ENG-48 between the U.S. Department of Energy and the University of California for the operation of Lawrence Livermore National Laboratory.

FIELD OF THE INVENTION

This invention relates generally to porous metallic bodies, and more particularly to those having substantially uniform porosity with pore size less than about 200 microns, interconnecting porosity, and density of less than about 25% theoretical.

BACKGROUND OF THE INVENTION

Metallic powders or mixtures are generally fashioned into solid forms by first forming them into a die cavity and applying pressure to form a compound. In a separate operation, the compact is heated and forms a coherent mass. Optionally, the uncompacted powder can be heated without first applying pressure.

The shape and size of the cavity may be exactly as required by the finished part or may be some intermediate configuration. The pressing operation is usually carried out at room temperature, however, warm or even hot pressing can be employed. This pressing operation is used to consolidate the powder into a mass which can be handled and which has a certain dimensional configuration. During pressing the coherent mass is formed through the processes of interparticle binding and interlocking. Application of heat during pressing, or as a separate step, is such as not to cause melting of the powder. The temperature to which the pressed compact has been heated is below, and usually very close to, the melting point of the metal as it is elemental, or aqueous temperature of any alloy which is formed.

In many applications porous solids are needed. Metallic foams are one example of such porous solids. Their internal structure is one of a plurality of randomly dispersed closed cells throughout a metal matrix. Limited porosity is achieved. One method of foam production is to employ a heat decomposable foaming agent to generate gas and form the cells. Such foaming techniques frequently produce closed cells which are non-uniform or are undesirably too large. These problems have been addressed to some extent by increasing the viscosity of the molten metal of the various viscosity-increasing agents to aid in a subsequent flowing step.

U.S. Pat. No. 3,816,952, dated June 18, 1983, to Niebylski et al, provides a method for producing an aluminum base foam which comprises the following steps: increasing the viscosity of a molten aluminum-base metal with a viscosity-increasing amount of a viscosity-increasing agent; and, treating the viscous melt thereby produced. Oxygen is mentioned as one of the preferred foaming agents. The urea system produced is heated sufficiently to thermally decompose the flowing agent to release gas which makes the foaming take place (formation of closed cells). Porosity arises within the interstices between the closed cells.

U.S. Pat. No. 3,669,654, dated June 13, 1972, to Barry, Jr., discloses the process of foam production where a metal or alloy is melted and a viscosity-strength increasing agent added. The agent must contain oxygen and form oxide particles in situ. This composition is thinned and brought to a proper temperature before the blowing agent is introduced.

Metallic bodies, including foams, disclosed to date lack a uniform porosity coupled with high surface area and minimum flow resistance. By this is meant gas flows through the solidified metallic body. A porous metallic body having low density, high surface area, and an interconnecting porosity structure sufficient to provide the flow-through of gas through the body is highly desirable. It would be an advancement in the art to provide such a porous metallic body possessing these characteristics.

SUMMARY OF THE INVENTION

Accordingly, an object of the invention is to provide a method for producing porous metallic bodies.

Another object of the invention is to provide a method for producing porous metal bodies having fine pore size.

Yet another object of the invention is to provide a method for producing porous metallic bodies having uniform connecting porosity.

Still another object of the invention is to provide a method for producing porous metallic bodies having high internal surface areas.

Yet another object of the invention is to provide novel porous metallic bodies having uniform porosity, an internal high surface area, and which provide for the flow-through of gas through the body with minimal resistance.

Additional objects, advantages and novel features of the invention will be set forth in part in the description which follows, and in part will become apparent to those skilled in the art upon examination of the following, or may be learned by practice of the invention. The objects and advantages of the invention may be realized and obtained by means of the instrumentalities and combinations particularly pointed out in the appended claims.

To achieve the foregoing and other objects in accordance with the purpose of the invention as embodied and broadly described herein, a method is disclosed for producing a porous metallic body. This method comprises providing a packed metal hydride in an amount of about 15–60 percent of theoretical density in a confining container under vacuum conditions of about $10^{-6}$ to $10^{-10}$ Torr. The hydride is heated within the container at a rate of about 0.1° C./min. to 10° C./min. until a temperature of about greater than the temperature at which the dehydride decomposes to hydrogen and metal is obtained, producing metal and hydrogen gas. As the gas is evolved within the container it is removed at a rate sufficient as to maintain a vacuum therein of at least about $10^{-2}$ Torr. After the hydrogen gas has been removed from the container, the metal continues to be heated in a second stage to a greater temperature but less than about ½ to ⅔ the temperature at which the metal melts. This second heating stage occurs at a rate of about 3°–7° C./min. The product is then allowed to cool.

In yet another aspect of the present invention, novel porous metallic bodies are produced which have substantially uniform pore size of about less than 200 microns and a density of less than about 25 percent theoretical. The pores within the structure are generally interconnecting and permit the flowthrough of a gas through the structure.

Metallic bodies as produced by the method of the present invention offer unique properties of having interconnecting pores, a pore size of about less than 200 microns, a porosity of about 50–85 percent and a density of 50–15 percent theoretical respectively.

These materials are particularly suited for use as catalysts, filters and the like. Although any metal hydride which decomposes to the metal and hydrogen is suitable for purposes of the present invention, the preferred metal hydrides are selected from IIA, IIIB, IVB, VB, and rare earth hydrides.

DETAILED DESCRIPTION OF THE INVENTION

The method of the present invention provides a method for the formation of novel metallic porous bodies. Suitable metals include those that form hydrides and which decompose to yield the metal and hydrogen gas. Preferably, the metal is one selected from the IIA, IIIB, IVB, VB, and rare earth metals.

In the method of the present invention, a porous metallic body is formed by providing a packed metal hydride in an amount of about 15–60 percent of its theoretical density in a confining container which is maintained under vacuum conditions of about $10^{-6}$ to $10^{-10}$ Torr. More preferably, the vacuum conditions are about $10^{-8}$ to $10^{-10}$ Torr. The hydride is heated in the container at a rate of about 0.1° C./min. to 1° C./min. until a temperature higher than than the temperature at which the hydride decomposes to hydrogen and metal is obtained. The temperature employed is in the range of from about 270° C. to about 400° C., depending upon the metal hydride used. This produces the metal and hydrogen gas. During this first heating stage, hydrogen gas is produced and removed as it is produced from the container at a rate sufficient as to maintain vacuum conditions within the container of at least about $10^{-2}$ Torr. Essentially, as the hydride is heated under vacuum, pressure begins to build within the container. By practice of the present invention, pressure within the container is not allowed to go above $10^{-2}$ Torr. Evolution of the hydrogen gas cleans the hydride and metal of oxygen. The absence of oxygen is desirable in order to clean the metal surface, minimize oxide formation, and allow metal surfaces to sinter. It has been found that permitting oxygen to interact during this process results in the production of oxide films, reduced sintering of metal particles, and generally interferes with the desirable qualities of the proous metal component's mechanical properties.

Initially a great deal of hydrogen is evolved during the first stage heating operation. However, as the heating progresses and the hydrogen is removed, a peak is reached and the pressure within the container goes back to about its initial vacuum condition of about $10^{-6}$ to $10^{-10}$ Torr.

After the hydrogen gas has been removed the remaining metal in the container is heated to a temperature greater than the temperature obtained during the first heating operation, but less than about ½ to ⅔ the temperature at which the metal melts. This stage of heating occurs at a rate of about 3° to 7° C./min., preferably at about 5° C./min. Thereafter, the product is allowed to cool and a porous metallic body is produced having substantially uniform pore size of less than about 200 microns and a density of about less than 25 percent theoretical. More preferably, pore size (pore size distribution) is about 0.5–50 microns.

In the method of the present invention, the metal hydride surfaces are initially cleaned of oxide film during the first heating step. Subsequent heating of the metal (after removal of hydrogen) causes additional sintering of the metal structures to higher densities and thicker screens or webs for more strength. Essentially, the product which is formed comprises a plurality of chains which are linked together and which form the porous structure. Final metallic structure is controlled by the initial hydride particle size distribution, the packing of the hydride particles into the container, the rate of heating to decompose the hydride to metal and hydrogen gas, the rate of hydrogen pressure released, the purity of the environment within the container, and the maximum temperature and time constraints within which the final product is formed.

With regard to initial metallic hydrides, it is preferred that the hydride has a particle size of less than about 20 microns, and more preferably about 1 micron.

The metallic hydride is disposed within the container initially at about 15–60 percent theoretical density, more preferably about 25–60 percent, and still more preferably about 50–60 percent.

The present invention is applicable to any metallic hydride which decomposes to yield hydrogen gas and a remaining metal. Table I below lists metals and their corresponding hydrides which are particularly suitable for the present invention.

TABLE I

| Metal | Hydride |
|---|---|
| Ti, Zr, HF | $Ti_2$, $ZrH_2$, $HfH_2$ |
| V | VH |
| Nb | NbH |
| Ta | TaH |
| Cr | CrH |
| Ni | NiH |
| Pd | PdH |
| La, Pr, Nd, Sc | $LaH_2$, $PrH_2$, $NdH_2$; $ScH_2$ |
| Ce | $CeH_2$ |
| Sm | $SMH_2$, $SmH_3$ |
| Gd through Tm, Lu, Y | Dihydrides |
| Eu | $EuH_2$ |
| Yb | $YbH_2$ |
| Ac | $AcH_2$ |
| Th | $ThH_2$ |
| Pa | $PaH_3$ |
| U | $\alpha$-$UH_3$, $\beta$-$UH_3$ |
| Pu | $PuH_3$ |
| Li, Na, K, Rb, Cs | LiH, NaH, KH, RbH, CsH |
| Ca, Sr | $CaH_2$, $SiH_2$ |
| Ba | $BaH_2$ |
| Be | $(BeH_2)_n$ |
| Mg | $MgH_2$ |
| Ra | $RaH_2$ |
| Pu | $PuH_2$ |
| Am | $AmH_2$, $AmH_3$ |
| Cm | $CmH_2$ |

Metal hydrides formed from the metals of the IIA, IIIB, IVB, VB, and rare earth metals are preferred. The most preferred hydrides are $BeH_2$, $TiH_2$, and $UH_3$.

The container can be of any geometric configuration and made of any material which is compactable with the hydride and its decomposed metal and will accept the heat treatment necessary to decompose the hydride, followed by the subsequent sintering step. In one embodiment of the invention, a stainless steel cylindrical tube is employed having dimensions of ¼"×½". Heating of the hydride and metal can be achieved by any known conventional method. Such methods include but are limited to external resistance heaters, radiant heating, induction heating, laser heating, and the like. In one embodiment, an external resistance heater was employed.

The following examples are meant to exemplify certain embodiments of the invention and are not intended to limit the scope of the invention which is defined in the appended claims.

The porosity of the final product, the porous metallic body, is measured by conventional means. In one embodiment, the porosity is measured injecting a liquid such as mercury, carbon tetrachloride, acetylene tetrabromide, and the like, is injected into the pores under pressure in a quantity determined. This measures the open porosity of the metallic body. The total porosity is then measured by determining the density of the body. The density is expressed in terms of percent of the theoretical density of the solid substance.

EXAMPLE 1: Be POROUS METALLIC BODY

Porous bodies comprising Be were formed. −100 mesh power $BeH_2$ (≈20 microns dia) was packed with density of about 60 percent theoretical in a stainless steel cylindrical tube having the dimensions of $\frac{1}{4}'' \times \frac{1}{2}''$. The hydride was maintained within the container under vacuum conditions of about $10^{-6}$ Torr and then heated at a rate of approximately 1° C./min. until a temperature of about 300° C. was reached. During the heating process, hydrogen gas was evolved and removed from the container. Pressure within the container did not exceed $10^{-2}$ Torr. After the temperature of 300° C. was obtained, most of the hydrogen gas had been evolved and removed from the container. The remaining Be was relatively clean of oxide film. During the second stage heating operation, the Be was heated from about 300° C. at a rate of about 5° C./min. to a temperature of about 335° C. and held at temperature for 30 min. After cooling, the product was removed from the container and a density of about 15 percent theoretical was achieved. Initially, 2.5 grams of $BeH_2$ were decomposed to Be.

EXAMPLE 2: URANIUM POROUS METALLIC BODY

About 30 grams of $UH_3$ (grain size of about 220 microns) are packed to a density of about 50 percent theoretical in the container disclosed in Example 1 above. A vacuum condition of about $10^{-6}$ Torr is maintained in the container after the hydride is exposed therein, and the hydride is heated at a rate of approximately 0.5° C./min. until a temperature of about 270° C. is reached. Again, during this first heating stage hydrogen gas is evolved and removed from the container, and the pressure within the container is not allowed to exceed $10^{-2}$ Torr. In the second stage of heating, also maintained under vacuum conditions of about $10^{-6}$ Torr, the uranium exposed within the container is heated at the rate of 5° C./min. to a temperature of about 750° C. for ≈30 min.

EXAMPLE 3: TITANIUM POROUS METALLIC BODY 15 grams of $TiH_2$ is disposed in the container described in Example 1 above, and heated under vacuum conditions ($10^{-6}$ Torr) at a rate of 1° C./min. to a temperature of about 400° C. Again, during this time period hydrogen is evolved, the pressure within the container increases but is not permitted to exceed $10^{-2}$ Torr, and the hydrogen evacuated therefrom. In a second stage of heating, at a rate of about 5° C./min., a temperature of about 1150° C. is obtained for ≈30 min.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A method of making a porous metallic body, comprising:

(a) providing a powdered metal hydride of a particle size of less than about 220 microns in an amount of about 15–60 percent theoretical density in a confining container under vacuum conditions of about $10^{-6}$ to $10^{-10}$ Torr;

(b) heating said hydride disposed therein at a rate of about 0.1° C./min. to 1.0° C./min. to a temperature higher than the temperature at which said hydride decomposes to yield hydrogen and metal;

(c) removing hydrogen gas as it is produced from said container at a rate sufficient as to maintain a vacuum of at least about $10^{-2}$ Torr within said container, said removal of hydrogen gas occurring until substantially all hydrogen is removed from said hydride and only the metal remains within said container;

(d) heating said metal of step (c) to a temperature greater than the temperature obtained in step (b) but less than about $\frac{1}{2}$ to $\frac{2}{3}$ the temperature at which said metal melts, said heating occurring at a rate of about 3°–7° C./min.; and (e) allowing the product of step (d) to sinter and then cool.

2. The method according to claim 1, wherein said powdered metal hydride of step (a) has particle size of less than about 20 microns.

3. The method according to claim 1, wherein said powdered metal hydride disposed in said container in step (a) is packed with an amount sufficient to yield a density of about 60 percent theoretical.

4. The method according to claim 1, wherein said metal hydride is heated in step (b) at a rate of about 1° C./min.

5. The method according to claim 1, wherein said metal disposed within said container is heated during step (d) at a rate of about 5° C./min.

6. The method according to claim 1, wherein said metal hydride is selected from the group consisting of Group IIA metal hydrides, Group IIIB metal hydrides, Group IVB metal hydrides, Group VB metal hydrides and rare earth metal hydrides.

7. The method according to claim 1, wherein said metal hydride is $BeH_2$.

8. The method according to claim 1, wherein said metal hydride is $UH_3$.

9. The method according to claim 1, wherein said metal hydride is $TiH_2$.

10. A porous metallic body produced according to the method of claim 1.

11. A porous metallic body according to claim 10, wherein said metallic body has a substantially uniform pore size of less than about 200 microns, a density of less than about 25 percent theoretical, and is a metal selected from the group consisting of Group IIA metals, Group IIIB metals, Group IVB metals, Group VB metals and rare earth metals.

12. A porous metallic body according to claim 11, wherein said metallic body is Be.

13. A porous metallic body according to claim 11, wherein said metallic body is U.

14. A porous metallic body according to claim 11, wherein said metallic body is Ti.

* * * * *